United States Patent [19]

Saruwatari

[11] 4,114,375

[45] Sep. 19, 1978

[54] PUMP JACK DEVICE

[75] Inventor: Minoru Saruwatari, Calgary, Canada

[73] Assignee: Canadian Foremost Ltd., Calgary, Canada

[21] Appl. No.: 832,046

[22] Filed: Sep. 9, 1977

Related U.S. Application Data

[63] Continuation-in-part of Ser. No. 699,134, Jun. 23, 1976, Pat. No. 4,047,384.

[30] Foreign Application Priority Data

Apr. 9, 1976 [CA] Canada ..... 249962

[51] Int. Cl.[2] ..... F15B 9/02

[52] U.S. Cl. ..... 60/372; 60/381; 60/DIG. 101

[58] Field of Search ..... 60/369, 371, 372, 373, 60/380, 381, 382, 383, 445, DIG. 10; 91/218, 275, 304

[56] References Cited

U.S. PATENT DOCUMENTS

| | | | |
|---|---|---|---|
| 1,839,611 | 1/1932 | Stafford | 60/372 |
| 2,347,301 | 4/1944 | Twyman et al. | 60/372 |
| 2,645,899 | 7/1953 | Aller et al. | 60/372 |
| 2,651,914 | 9/1953 | Joy | 60/372 |
| 3,986,355 | 10/1976 | Klaeger | 60/369 |

*Primary Examiner*—Edgar W. Geoghegan

*Attorney, Agent, or Firm*—Sughrue, Rothwell, Mion, Zinn and Macpeak

[57] ABSTRACT

A pump jack, such as the type capable of use in pumping crude oil from an oil well, the pump jack including a double acting piston and cylinder motor with the piston rod of the motor being adapted to be connected to the polished rod projecting upwardly from a well head. A variable displacement hydraulic pump, which is driven by a motor or engine, is included in a closed hydraulic loop wherein conduits are connected to a pair of output ports of the pump. A pump control means controls the direction and volume of flow in the loop so as to establish the stroke of the piston rod. A compressible fluid counterbalance is provided for accumulation of energy during a down stroke of the piston rod so that the energy may be returned to the piston during the up stroke. An economical and versatile unit may be produced by mounting a counterbalance cylinder coaxially above the motor and providing the counterbalance with an additional closed chamber in fluid communication with a charged chamber of the counterbalance. The additional chamber may be provided in hollow structural members forming a support portion of a pump jack tower. The tower can be mounted on a portable base or deck by way of a pivot connection so that the tower can be swung down to a horizontal transportation position.

9 Claims, 6 Drawing Figures

PUMP JACK DEVICE

This is a continuation-in-part of copending U.S. patent application Ser. No. 699,134, filed June 23, 1976 now Pat. No. 4,047,384, issued Sept. 13, 1977.

The invention relates to a pump jack of the type used to pump crude oil from an oil well.

The conventional oil well pump, which is of the walking beam type, has many disadvantages. Since the walking beam is driven usually from a rotating eccentric the stroking cycle is fixed. The characteristics, such as fluid level, specific gravity, viscosity and pressure, vary from well to well, and although the strokes per minute, stroke length and position of the stroke can be adjusted, with considerable labour involved, in order to adapt the pump to a particular well, the nature of the velocity profile provided by the rotating eccentric does not result in efficient pumping. For example, if the strokes per minute are adjusted to raise the sucker rod quickly, the sucker rod may have a tendency to float on the downward stroke or the down hole pump may not have a sufficient opportunity to fill between the upward and downward strokes. If the speed is slowed to avoid such difficulties, then the portion of the cycle involved in the raising stroke takes a much longer period than is actually required. The approach which is taken is that of operating with the optimum speed while realizing that in a number of respects the pumping cycle has many inefficient portions. An additional problem is that the characteristics of some wells continuously change so that the operating efficiency may worsen over a period of time. Readjustment from time to time to again attempt to achieve optimum efficiency requires shutting down the pump and possibly many labour hours before restarting the pump.

The large massive parts customarily used in the walking beam type pump produce high dynamic forces which are difficult to control. The shipping, erecting and maintenance of such equipment is expensive. The start-up power demands are extremely high, and considerable energy is wasted in operation. High rod stress variations are also frequently experienced.

Although a number of different types of pump jacks, which include drive systems other than the walking beam arrangement, have been proposed, they generally have not proven satisfactory for one reason or another, and as a result the vast majority of oil well pumps in use today are of the walking beam type. The problem is becoming more acute, however, since it is becoming increasingly important to remove crude oil from less productive wells.

It is an object of the present invention to provide a pump jack which is efficient in operation and is economical to ship, erect and maintain.

According to the pump jack of the present invention, there is provided a double acting equal displacement, through rod type piston and cylinder motor with means for connecting a piston rod of the motor to a polished rod of the wall head. The motor is arranged to be mounted above its well head and coaxial with the polished rod. A variable displacement type hydraulic pump, which has a pair of output ports, is provided with hydraulic conduits each placing one of the ports in communication with an opposite end of the motor so as to form a closed hydraulic loop with the motor and pump. The pump has drive means and a pump control means for controlling the direction and volume of flow in the loop so as to thereby determine the length and position of the stroke as well as the velocity of the piston rod. A compressible fluid counterbalance is provided for accumulation of energy during a down stroke of the piston rod and returning the energy to the piston rod during an up stroke of the piston rod.

The pump jack may be controlled to provide a preferred type of pumping stroke for any particular well and yet the overall unit may be extremely small and portable relative to a walking beam type pump.

In a preferred embodiment, the counterbalance means is in the form of a cylinder which has a piston therein, and means connect the piston of the counterbalance means to the piston in the motor so as to be driven therewith. The cylinder and piston of the counterbalance means form a chamber containing a gaseous charge disposed to be compressed by the piston during the downward stroke of the polished rod. In this form of the invention the cylinder of the counterbalance means is coaxially mounted with the motor, and the piston of the counterbalance means is directly connected to the piston rod formed by the through rod of the motor.

The motor and counterbalance means thus form part of a tower structure, which may be pivotally mounted on a portable base so that the tower can be lowered to a substantially horizontal transporting position. The tower structure includes additional supporting means which may have hollow portions forming an additional closed chamber in communication with the charged chamber of the counterbalance means.

In the accompanying drawings:

FIGS. 1*a* and 1*b*, show a partially schematic diagram of the pump jack according to one embodiment of the present invention;

Figure 1A:
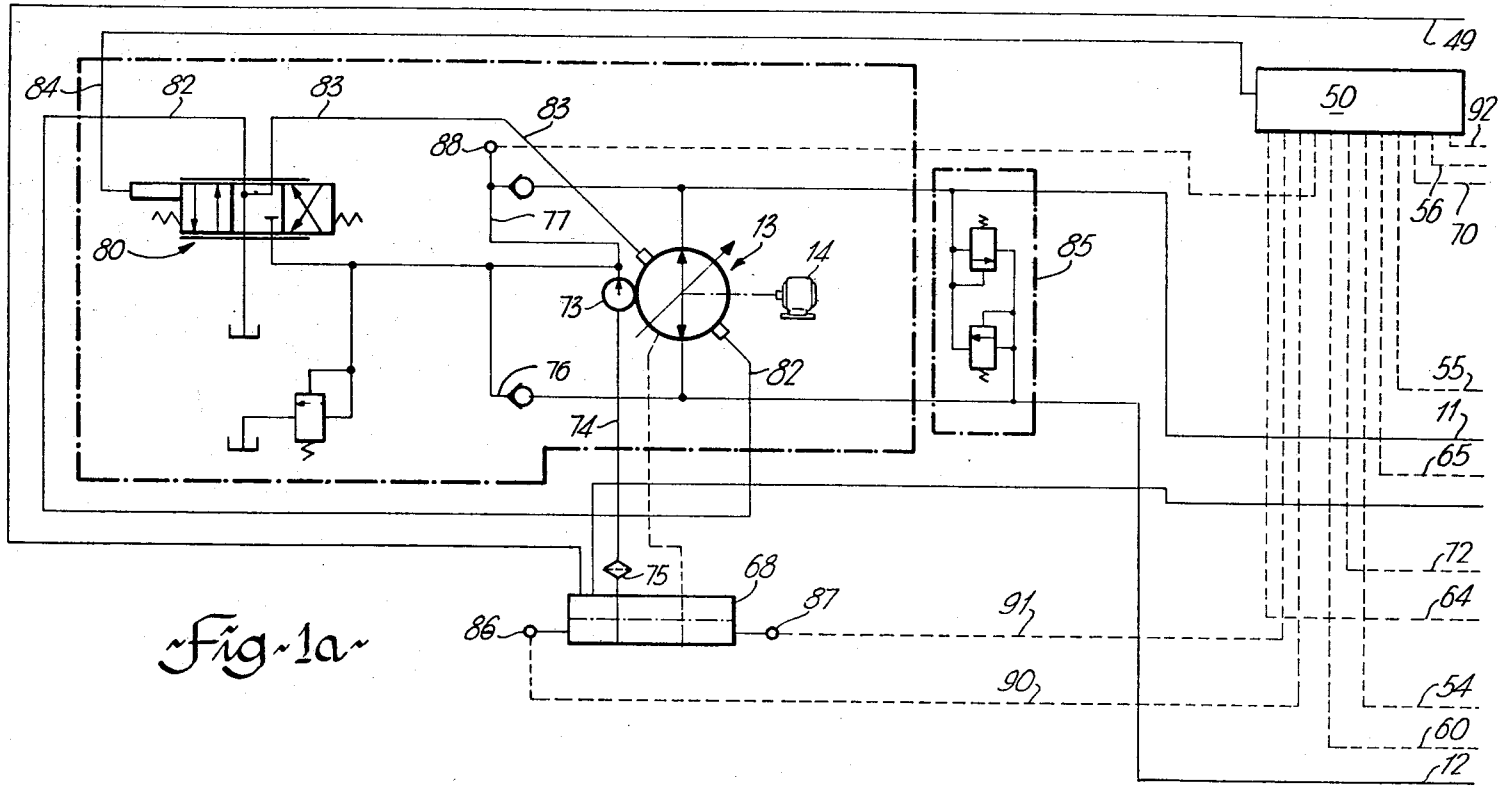

In FIGS. 1*a* an 1*b*, the reference number 10 denotes a piston and cylinder motor, which is connected by way of a pair of fluid conduits 11 and 12 and to a variable displacement type hydraulic pump 13 driven by a prime mover 14.

The motor 10 includes a cylinder 15 and a piston 16 is reciprocably disposed within the cylinder 15. The motor 10 is preferably of the equal displacement through rod type, piston 16 having a first piston rod 17 an a second piston rod 18. The cylinder 15 has its opposite ends closed, with piston rod 17 passing through seal means 21 in lower end 20 and piston rod 18 passing through seal means 23 in upper end 22. In the embodiment shown; rods 17 and 18 are of the same diameter so as to provide an equal displacement hydraulic cylinder. Conduit 11 provides for the flow of fluid to and from one port of the pump 13 and the space between piston 10 and upper end 22, and conduit 12 provides for the flow of fluid to and from another port of the pump 13 and the space between the piston 16 and the lower end 20.

A compressible fluid counterbalance means 24 is mounted to the top of the motor 10 and the complete assembly of the counterbalance means 24 and motor 10 is carried by proper supporting means such as a casing 19 which may be secured to the top of a well head 25. Alternatively, a tripod mounting, which can be designed to permit simple alignment with screw adjustments, could be provided. The counterbalance means and motor assembly are mounted directly over the well head 25. A polished rod 28 is connected to a sucker rod chain 26 which extends down into the well and carries a pump plunger 27 at its lower end. The well head includes a stuffing box 29 through which the polished rod 28 passes and a flow line 30 is provided through which the output of the well is pumped by way of reciprocation of the sucker rod chain 26. The lower end of the piston rod 17 is provided with means 31 for connecting the piston rod 17 to the polished rod 28 so that the sucker rod 26 is driven by piston 16 reciprocating within cylinder 15.

The counterbalance means includes an inner sleeve or cylinder 32 in which a piston 33 is reciprocably mounted, the piston 33 being connected to the upper end of piston rod 18. An outer cylinder 34 is concentrically disposed about inner cylinder 32 so as to define an annular chamber 35 about the inner cylinder 32. The space in inner cylinder 32 below the piston is in communication with the chamber 35 via a port 36. The counterbalance means 24 is coaxially mounted on the motor 10 and the entire assembly is coaxial with the polished rod 28.

The upper ends of cylinders 32 and 34 are closed by an upper end 37. A closed expansion chamber 40 is carried above the upper end 37 and is in communication with the space above piston 33 by way of a port 41. A source 39 of pressurized inert gas, such as nitrogen, is connected by way of a conduit 43 to the chamber 35. A regulator 44 is located in the conduit 43 so as to control a high pressure charge, possibly in the order of 400 p.s.i. in the chamber 35 and below piston 33. Connected to conduit 43 on the output side of the regulator 44 is a conduit 45 which extends to the chamber 40. The conduit 45 includes a regulator 46 which regulates the nitrogen charged expansion chamber 40, the regulator allowing a much lower pressure, say 1 or 2 p.s.i., in the expansion chamber.

When piston 16 is positioned at the top of its stroke and pressurized fluid is conducted to the space above the piston 16, the piston is forced downwardly as fluid flows out of cylinder 15 through conduit 12. The sucker rod is thus lowered and simultaneously the gaseous charge below the piston 33 is compressed so as to accumulate energy from the system as the sucker rod is lowered. When the piston 16 reaches the bottom of its stroke, the fluid is exhausted from above piston 16 via conduit 11 and pressurized fluid is admitted to the space below the piston 16 to force the piston 16 upwardly with the assistance of the expansion of the fluid in annular chamber 35 and below piston 33, thereby raising the sucker rod 26. When the piston reaches the top of its stroke, a dwell may be provided before the above cycle is repeated.

It may be seen that with the particular design of the counterbalance shown, i.e., a relatively small inner cylinder with the annular chamber disposed thereabout, a more effective charge of pressurized gas can be utilized for the length of the stroke, which is fixed, of course, to the length of the stroke of piston 16. The charge may be regulated so that the power provided through conduit 12 to raise the sucker rod, in what might be termed the working stroke, is substantially equal to power provided through conduit 11 for the downward stroke during which the charge is compressed.

Rather than having the space above piston 33 open to atmosphere, it is preferable to provide the expansion chamber 40 in order to eliminate the possibility of contaminates entering the cylinder 32. A layer of oil 46 may be carried above the piston 33 for cooling, sealing and lubrication purposes. Another layer of oil 46*a* may be provided at the bottom of cylinder 32 to enhance the operation of seal 23 and lubricate rod 18.

As an alternative to the concentrically disposed chamber 35, a completely separate pressure vessel could be utilized. As an example, the legs of the previously described tripod mounting could be made in a hollow configuration to provide accumulator chambers or other provisions may be made in a tower structure to provide an accumulation chamber as will be described in relation to FIGS. 2 to 5.

In addition to the expansion chamber 40 being hermetically sealed and operated within a closed and controlled atmosphere formed by the low pressure inert gas by way of its connection to conduit 45, other components, such as a main reservoir 68, may be similarly isolated from the free atmosphere at the well head. Conduit 49, for example extends from conduit 45 to the space above the oil in the reservoir.

The jump jack includes a control panel 50, which will be described as including electronic components, but a fluidic system could also be utilized. Transducers 51, 52, 53 are provided to sense the pressures at the lower end of the motor 10, at the upper end of the motor 10, and below the piston 33, respectively. The transducers 51, 52 and 53 are connected to the control panel 50 by way of leads 54, 55 and 56, the leads thus conducting to the control panel separate signals indicative of the pressures at opposite ends of the motor 10 and in the counterbalance means. A positional transducer 57 is located beside the cylinder 15 and transfers a signal by way of lead 60 to the control panel 50, the signal being indicative of the position of the piston 16. Since the position of piston 33 is indicative of the position of piston 16, instead of positional transducer 57 located beside the cylinder 15, a positional transducer might be located axially within the cylinder 32. Piston rod 18 could be hollow in such an arrangement so that the position transducer extends downwardly into the rod and does not engage either the piston 33 or rod 18 but provides a signal which reflects the relative position of the piston 33.

Return lines 58 and 59 may be provided to the reservoir 68 for returning fluid leaking around seal means 21 and 23. A transducer 61 may be associated with return line 58 and a transducer 62 may be associated with return line 59, the transducers 61 and 62 having leads 64 and 65 for transferring to the control panel signals indicative of whether the seals are functioning satisfactorily. Another transducer 66 may be associated with a seal 67 at the bottom of cylinder 33, for providing a signal via lead 70 indicative of the operability of seal 67. A transducer might also be provided in conduit 43 to provide a signal when the pressure of source 39 falls below a predetermined value.

A further transducer 71, which is connected to the control panel 50 by a lead 72, may be provided in the well head, so that the presence of an unsatisfactory condition at the well head will be made known to the control panel.

The variable displacement pump may be of one of the types which are commercially available, such as those sold as a 20 series by Sundstrand or Models 28 through 149 sold by Eaton Corporation. These pumps are of the across-centre swashplate type. A charge pump 73 draws fluid from reservoir 68 via a conduit 74 through a filter 75 which provides make-up fluid to the main closed loop, which includes pump 13, conduits 11 and 12 and motor 10, via conduits 76 and 77. The output of charge pump 73 is further conducted to an electro-hydraulic servo means 80. The electro-hydraulic servo means 80 has a pair of outlet conduits 82 and 83 conducting fluid to pump 13 to thereby control the position of the swashplate, which in turn determines the volume flow and direction of flow in the closed loop. The activity of the means 80 is controlled by a lead 84 extending from the control panel 50 to the control valve 80.

A cross-over relief valve system 85 is provided between conduits 11 and 12. The output of charge pump 73 may be monitored by a transducer 88 connected to the control panel 50 by lead 85. Additional transducers 86 and 87 associated with the reservoir 68 are adapted to send signals to the control panel 50 via leads 90 and 91 indicative of the level of fluid and its temperature.

In addition to providing an output signal to control the electro-servo means or control valve 80, via lead 84, the control panel is also capable of conducting a signal via a lead 92 to control the actions of the pressure regulator valve 44. Moreover, the control panel may be adapted to produce other signals, such as one which is capable of starting or stopping prime mover 14 which may be, for example, an electric motor or an internal combustion engine under predetermined conditions.

Figure 1B:
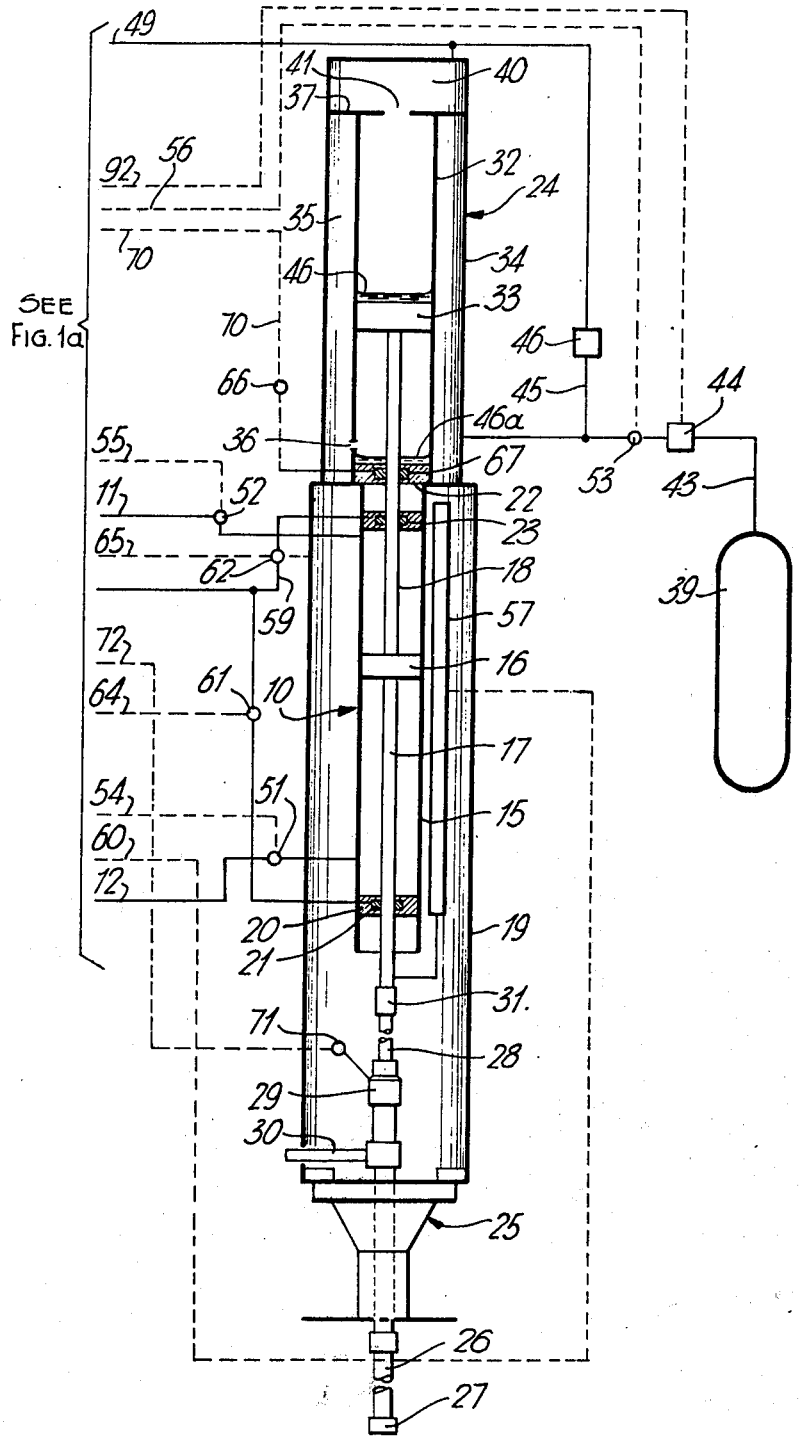

In the embodiment shown in FIGS. 1*a* and 1*b*, the signals from transducers 51, 52 and 53 may be summed by the control panel, and compared, for example with a predetermined value for a particular location of the piston 16, which location is indicated by transducer 57. A signal is produced as a result of the comparison, which signal is transferred to electro-servo control valve 81. As a result, the volume flow and/or direction of flow in conduits 11 and 12 may be modified so that throughout the pumping cycles each segment of the velocity profile is controlled. The control panel may also be programmed to deviate completely from the normal pumping cycle. For example if extreme pressures, which could be caused with a jammed plunger are indicated by the transducers, the pumping cycle may be terminated. The panel may be further programmed to restart the cycle in a number of hours, but again terminate the pumping cycle if a jammed condition is still indicated. If the readings from the transducers indicate a gas lock, then proper signals could be provided to the pump to lower the stroke to a position in which the pump plunger could be tapped on the bottom a number of times to free the gas, after which the piston is raised to cycle in its normal stroke higher in cylinder 15.

The control panel could also be equipped to receive and/or transmit signals to a central control station. Thus, the operation of the pump could be controlled at least in part or it could be adjusted from a remote station. With this arrangement its operation could also be monitored and maintenance carried out so as to prevent costly break-downs.

As an alternative to the electronic control panel which continually receives all of the readings from the system, described above, the control panel might be simply provided with a program which might be set up for the particular well concerned and then simply repeats the preferable velocity profile throughout the selected stroke. As an alternative to the electro-hydraulic servo-means 80, a hydraulic servo could be controlled by a continuously rotating cam or similar mechanical means to provide a repeated pumping stroke having a total profile selected for the well.

In the present invention an extra long stroke is possible, which has advantages over known pumps and would result in efficient pumping, this type of stroke being possible by simply utilizing a long stroke cylinder mounted directly on the well head. It may be advisable in such an arrangement to have the piston rod passing through the stuffing box and not mount the counterbalance on top of the cylinder.

In the arrangement shown in FIGS. 2 to 5, the motor 10 and counterbalance means 24 form part of a tower structure 100, the tower structure having a lower or leg portion 101, and intermediate portion 102 and an upper portion 103. The tower structure 100 is mounted adjacent one end of a portable base 104 which may be in the form of a skid 105 providing a deck 106 on which is mounted a pump and control housing 107 enclosing the elements generally shown in FIG. 1*a*. The tower structure 100 is connected to the base by way of pivot connecting 110 which swing the lower structure between an upright operating position as shown in solid lines in FIG. 2 and a substantially horizontal transporting position as shown in chain dotted lines also in FIG. 2. The housing 107 is shown as having a support member 111 on which the tower structure may rest when in the transporting position.

The lower portion 101 of the tower structure has two pairs of legs 113, 114, which are rigidly connected at their upper ends to a bottom horizontal plate 112 of the intermediate portion 102. The two pairs of legs diverge downwardly. The two legs forming the first pair 113 are parallel, as may be seen in FIG. 4, and have aligned journal bearings 115 at their lower ends. Adjacent the one end of the base 104, there are provided upwardly extending lugs 117, and pins 116 are received in bearings 115 and openings in lugs 117 so that the lower structure can swing about a horizontal axis which extends transversely of the elongated deck 106. A horizontal bar 120 is secured across legs 113 and is provided with end lugs 121, 121. The lugs 121, 121 have openings 122, 122 which receive pins (not shown) so as to pivotally connect thereto a cylinder 123 of a piston and cylinder type hydraulic motor 124. The motor has a piston rod 125 extending therefrom, and the piston rod is pivotally connected at its outer end to lugs 126. Pressurized hydraulic fluid may be selectively fed into either end of cylinder 123 so as to cause the motor to either expand or contract. When expanded the lower structure is held upright, and as the motor is contracted the lower structure is lowered to its transporting position. In actual construction, there is a motor 124 at each side of lower portion 101, although only one motor has been shown.

The second pair of legs 114 also has openings 128 at their lower ends of the legs so that when in the erected upright portion the legs 114 can be secured by pins 129 to ground anchors 139.

The intermediate portion of the lower portion includes motor 10, and a number of vertical columns 127.

Figure 5:
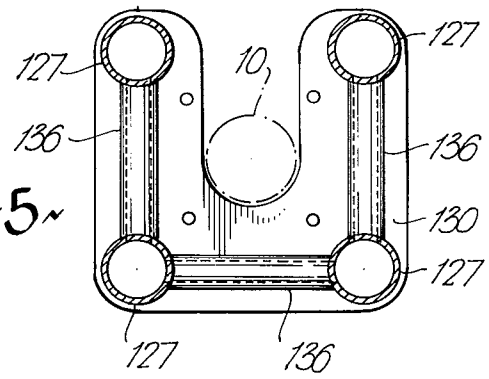
FIG. 5 is a cross section view of the supporting tower as taken from line 5—5 of FIG. 3 and on an enlarged scale.

The embodiment shown includes four columns 127, which are parallel to one another and equally spaced at the four corners of an imaginary square (see FIG. 5). The columns are secured together at the bottom by horizontal bottom plate 112, at the top by horizontal top plate 130, and in the middle by intermediate horizontal plates 131, 131. As shown in FIG. 5, the horizontal plates are shaped to receive central disposed motor 10 and its piston rod 17.

The upper portion of the tower includes only counterbalance 24, which is the equivalent only of the inner cylinder 32 and piston 33 shown in FIG. 1*b*. The cylinder is mounted coaxially above motor 10, and a piston rod connects the piston thereof directly to the piston in motor 10 (not shown). The counterbalance means projects upwardly form the intermediate portion 102. The lower end of the cylinder has a port corresponding to port 36 in FIG. 1*b*, and this port is connected by a conduit 135 to the interior of one of the columns 127, which columns are hollow tubular members. The interior of the four columns are interconnected by way of three pipe members 136 which are secured between the columns as shown in FIG. 5. The columns are sealed so that their interiors may thus be in communication with the charged volume below the piston of the counterbalance means to serve the same purpose as the outer cylinder 34 of FIG. 1*b*.

By utilizing a counterbalance means in combination with a closed hydraulic loop including a through rod type piston and cylinder motor and variable displacement type hydraulic pump, power requirements are substantially constant and high stresses are avoided. The mounting of the counterbalance means of the type disclosed coaxially above the motor results in vertical forces only which can be readily carried by a simple and lightweight support structure.

Figure 2:
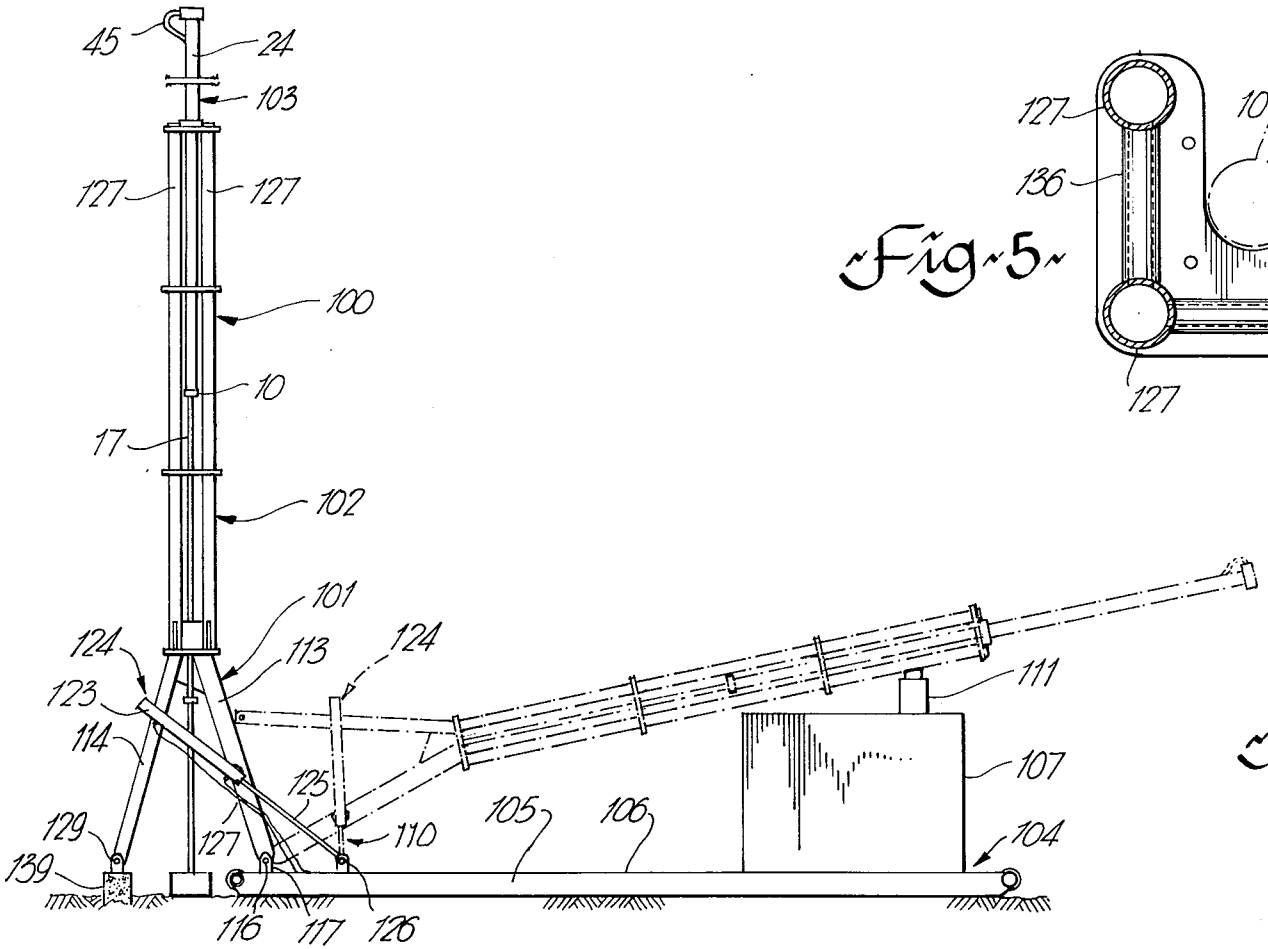
FIG. 2 is a side view of another embodiment of the invention and showing a skid mounted pump jack, the chain-dotted portion indicating the pump jack in a lowered position for transportation.
Figures 3, 4:
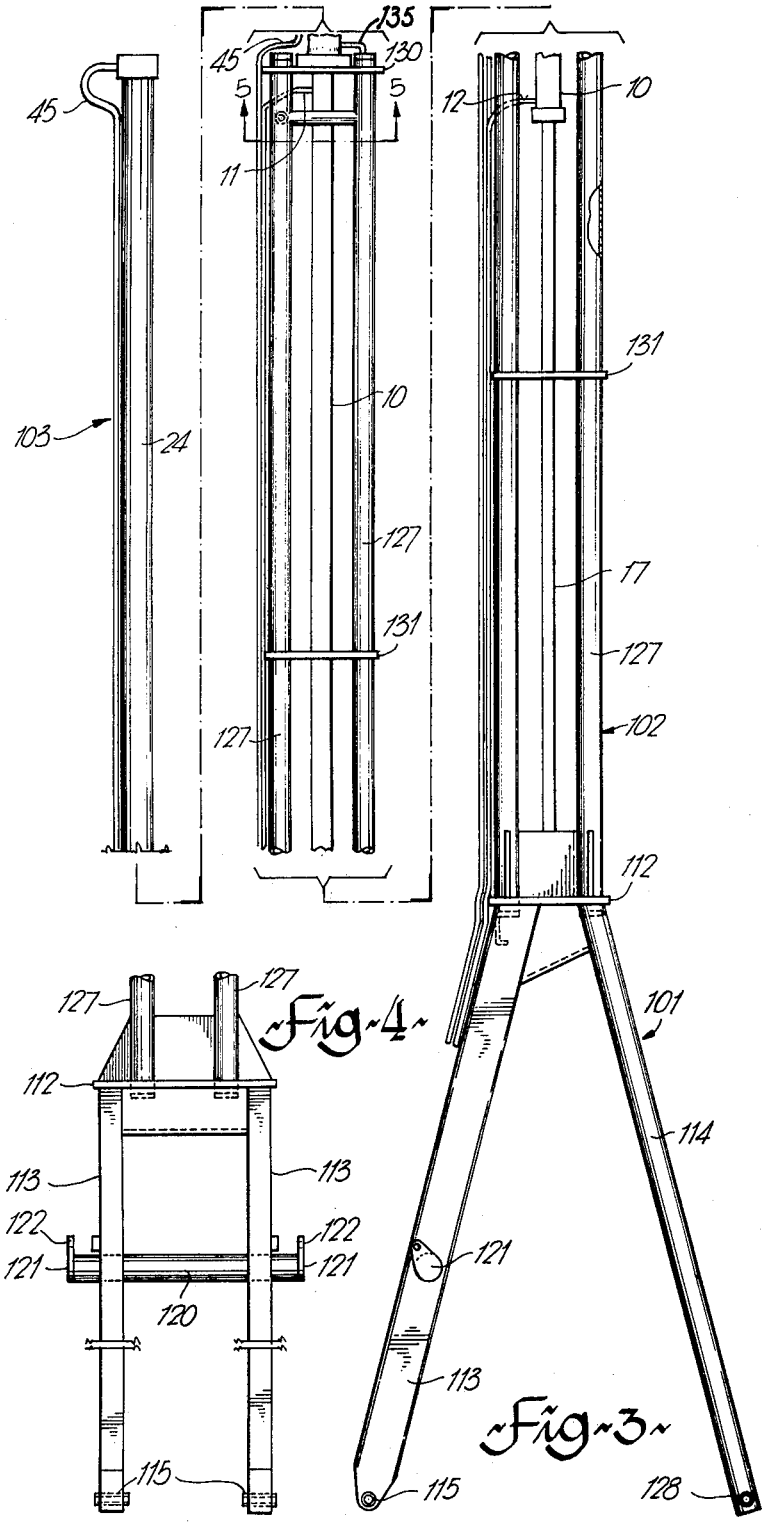
FIG. 3 is a side view of the pump jack, as shown in FIG. 2 on an enlarged scale.
FIG. 4 is an end view of a bottom portion of the supporting tower of the pump jack shown in FIGS. 2 and 3.

In the embodiment shown in FIGS. 2 and 5 the skid may be readily pulled onto the back of a trailer or truck. Alternatively the base could be provided with wheels, which could be retractable, so that the pump jack could be pulled as a trailer. The unit, after being pulled to the well site, can be put quickly into operation. The end of the base on which the tower is pivotally mounted is slid adjacent the well head 25. Anchor means 139 is properly located in the ground, and motors 124 are activated to raise the tower to its operating position so that pins 129 can be inserted. To remove the pump jack from an operating site, the piston rod 17 is disconnected from the polished rod 28, pins 129 are removed, and the motors 124 are activated so as to retract and lower the tower to the substantially horizontal position.

It is apparent that various modifications could be made to the disclosed embodiments by those skilled in the art without departing from the spirit of the invention as defined in the appending claims.

I claim:

1. A pump jack comprising a double acting equal displacement, through rod type piston and cylinder motor; means for connecting a piston rod of said motor to a polished rod in a well head; said motor being arranged to be mounted above said well head and coaxial with said polished rod; a variable displacement type hydraulic pump having a pair of output ports; a pair of hydraulic conduits each placing one of said output ports in communication with an opposite end of said motor and forming a closed hydraulic loop with said motor and pump; drive means for said pump; a pump control means for controlling the direction and volume of flow in said loop to thereby determine the length and position of the stroke and the velocity of said piston rod; a compressible fluid counterbalance means for accumulation of energy during a down stroke of said piston rod and returning said energy to said piston rod during an up stroke of said piston rod; said counterbalance means including a cylinder having a piston with means connecting the piston thereof to the piston of said motor for drive therewith, said cylinder and piston forming a chamber containing a gaseous charge disposed to be compressed by the piston of said counterbalance means during the downward stroke of said polished rod, said counterbalance means including an additional closed chamber means in communication with said chamber formed by said cylinder and piston, and the cylinder of said counterbalance means being coaxially mounted with said motor, said piston of said counterbalance means being directly connected to a second piston rod formed by the through rod of said motor.

2. A pump jack as defined in claim 1, wherein said motor and counterbalance means form part of a tower structure, the tower structure further including supporting means having hollow portions forming at least in part said additional closed chamber means in communication with said charged chamber.

3. A pump jack as defined in claim 2, wherein said supporting means includes a plurality of substantially vertical columns, the vertical columns being of tubular form with the interior thereof in communication with said charged chamber.

4. A pump jack as defined in claim 3, wherein said columns form an intermediate portion of said tower structure and extend upwardly to the upper end of said motor, said counterbalance means projecting above said intermediate portion.

5. A pump jack as defined in claim 4, wherein said charged chamber is defined by the cylinder of said counterbalance means below said piston therein, and further comprising conduit means placing said charged chamber in communication with the interior of at least one of said vertical columns.

6. A pump jack as defined in claim 2, wherein said tower structure is mounted on a portable base by way of pivotal connecting means, and further comprising means for swinging said tower structure between an upright operating position and a substantially horizontal transporting position.

7. A pump jack as defined in claim 6, wherein said portable base includes an elongated deck, said tower structure including first and second leg means, the first leg means being mounted to pivot on the axis extending transversely of said elongated deck immediately adjacent one end of the deck, the second leg means being arranged to be spaced outwardly from said one end of the deck for securement to ground anchor means when said tower structure is in the upright position.

8. A pump jack as defined in claim 7, wherein said leg means form a lower portion of said tower structure, said tower structure also including an intermediate portion rigidly fixed to said tower structure and being formed by a plurality of spaced vertical columns.

9. A pump jack as defined in claim 8, wherein said means for moving said tower structure between said positions includes a piston and cylinder hydraulic motor connected between the tower structure and the base whereby expansion or contraction of the hydraulic motor swings said tower structure from one of said positions to the other.

* * * * *